United States Patent [19]

Watson

[11] 4,012,613

[45] Mar. 15, 1977

[54] INERTIAL SWITCH

[75] Inventor: Jack H. Watson, Los Angeles, Calif.

[73] Assignee: The United States of America as represented by the Secretary of the Navy, Washington, D.C.

[22] Filed: Oct. 18, 1963

[21] Appl. No.: 342,320

Related U.S. Application Data

[62] Division of Ser. No. 78,189, Dec. 23, 1960.

[52] U.S. Cl. ..... 200/61.08; 200/61.45 R

[51] Int. Cl.[2] ..... H01H 35/14

[58] Field of Search ..... 200/61.08, 61.45 R, 200/61.53; 102/73

[56] References Cited

UNITED STATES PATENTS

| | | | |
|---|---|---|---|
| 1,189,403 | 7/1916 | Struble et al. | 102/73 |
| 1,768,678 | 7/1930 | Froelich | 102/73 |
| 2,873,680 | 2/1959 | Severance | 102/73 |
| 3,003,045 | 10/1961 | Tichenor | 200/61.08 |
| 3,038,042 | 6/1962 | Hall et al. | 200/61.08 |
| 3,075,465 | 1/1963 | Craig | 200/61.08 |
| 3,086,468 | 4/1963 | Mountjoy et al. | 200/61.08 |

*Primary Examiner*—Richard A. Farley

EXEMPLARY CLAIM

1. An inertial switch comprising a cylinder, a cap secured to one end of said cylinder, said cap having a central bore therethrough running parallel to said cylinder and a transverse hole communicating with said bore a wire inserted in the hole in said cap; a shearing member mounted in the bore, having a hole in which said wire is inserted and having a portion extending into the interior of said cylinder; a coil spring located within said cylinder having one end contacting said cap; a base secured to the other end of said cylinder; and a piston contacting said spring and base and having an elongated central portion; said spring being relatively long compared to the length required to stop the elongated portion of said piston from striking the portion of said shearing member extending into the interior of said cylinder when the switch is dropped from a distance of 40 feet onto a steel plate, whereby said wire is broken only when a predetermined sufficient energy is imparted to said spring.

2 Claims, 2 Drawing Figures

INVENTOR
Jack H. Watson

BY

ATTORNEY

INERTIAL SWITCH

This application is a division of my copending application, Ser. No. 78,189, filed Dec. 23, 1960.

This invention relates to land mines that are to be dropped on the ground from the air and more particularly to an inertial responsive switch which may be used as a safety element in an air-dropped, land mine.

Accordingly, it is an object of this invention to provide a new and improved land mine.

A further object of this invention is to provide a new and improved land mine that may be dropped from an aircraft.

It is an additional object of this invention to provide a new and improved influence responsive land mine which may be dropped from an aircraft.

It is a still further object of this invention to provide a new and improved inertial switch.

Various other objects and advantages will appear from the following description of one embodiment of the invention, and the novel features will be particularly pointed out hereinafter in connection with the appended claims.

In accordance with the teachings of the present invention suitable electronic apparatus may be used to trigger an explosive train within the land mine to be air-dropped including, for example, an electronic circuit which is rendered inoperative until the mine vehicle strikes the ground because of a novel inertial switch employed. This switch is responsive to the total kinetic energy, rather than the instantaneous acceleration, applied to the mine as it drops to the ground. It comprises an inertial weight which is normally retained by a coil spring. When the switch hits the ground, the inertial weight strikes a shearing member which is designed to cut an electrical wire thereby permitting actuation of the explosive primer and the firing ciruit.

Figure 1:
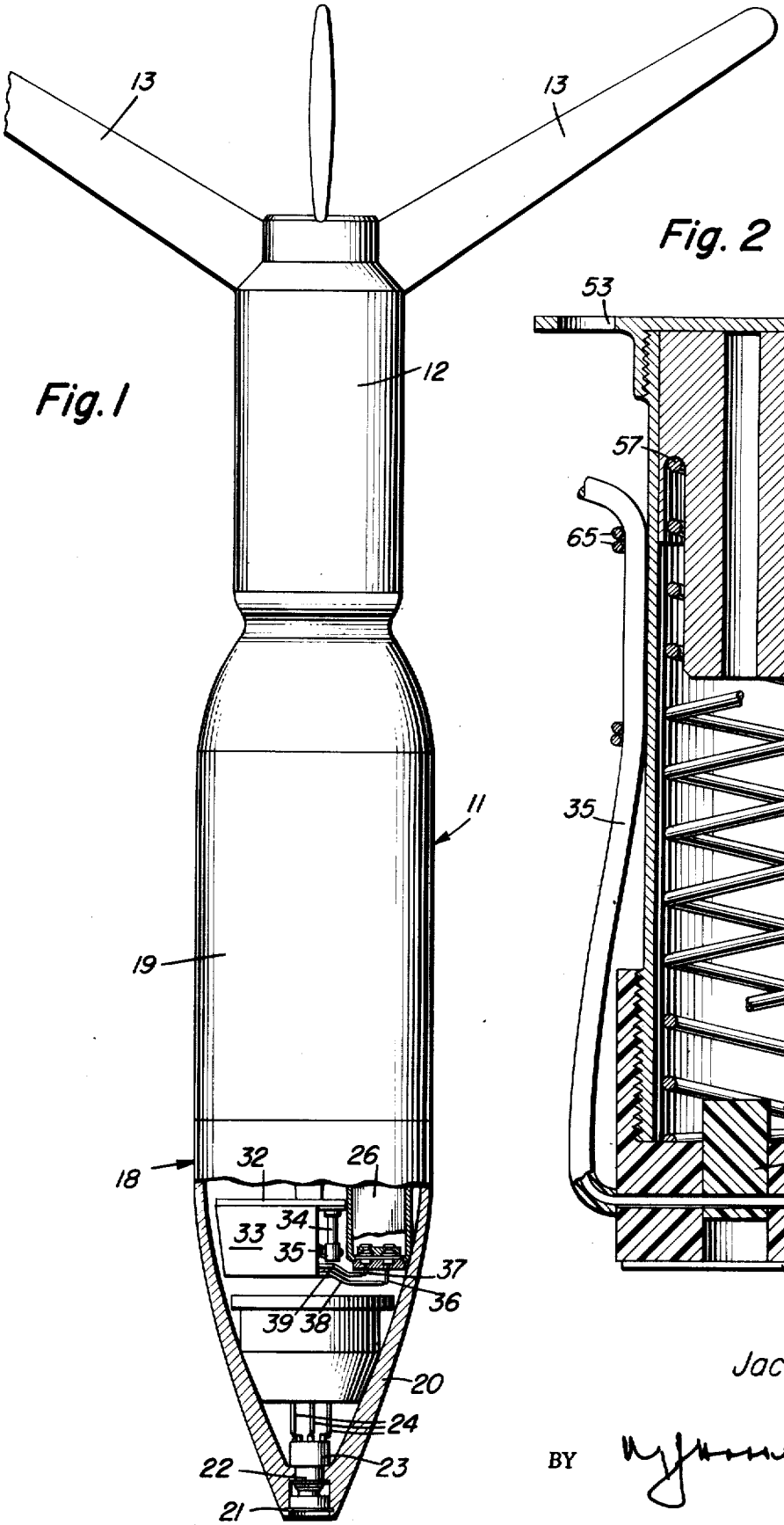
Figure 2:
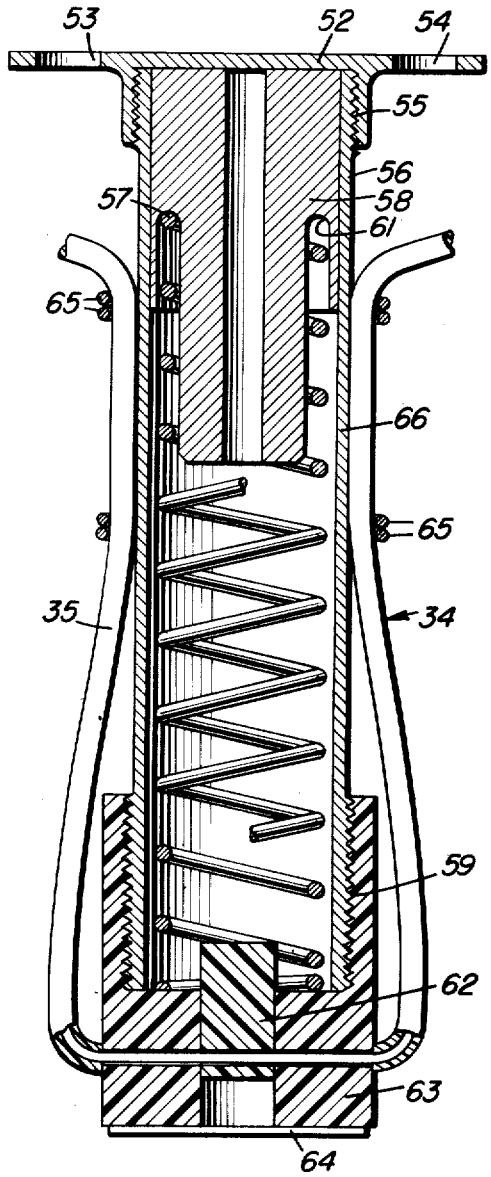

Reference is now made to the following description taken in connection with the accompanying drawings in which:

FIG. 1 is an overall view of the entire mine partly broken away to show a sectional view of the nose portion thereof; and FIG. 2 is a sectional view of the unique inertial switch herein employed.

In the detailed description of this invention like reference numerals designate like or corresponding parts throughout the several figures.

Referring now to FIG. 1 of the drawings, there is shown a mine body 11 having a mid or central portion 19 wherein the explosive charge is stored. Fins 13 insure aerodynamic qualities of the mine while it is dropping through the air and are secured to the tapered body portion 12, which is located to the rear of central portion 19.

When the mine vehicle 11 is dropped from the air it will enter the ground with nose portion 18 first. The mine will strike the ground with sufficient force to bury itself in most cases. It is contemplated that the mine may be provided with means for detecting changes in the earth's magnetic field resulting from the movement of a magnetic vehicle into the proximate area of the buried mine and for generating a voltage to the fuze 18 for actuating the fuze mechanism of the mine.

The fuze or nose portion 18 of the mine is shown in section in FIG. 1. The fuze 18 has an exterior shell 20 in which a plunger 22 is inserted at the nose or front end. The plunger 22 is held in place by a suitable means such as C-ring 21. The plunger 22 actuates switch 23 due to impact forces when the mine hits the ground, in a well known manner. Leads 24 electrically connect the switch apparatus 23 to an electronic assembly 33 located in the rear portion of the fuze and mounted on base 32, which is made of suitable electrical insulating material, such as plastic.

Power supply or battery 26 is located adjacent to electronic assembly 33 and the base upon which that assembly is secured. The battery is connected to assembly 33 by way of leads 38 and 39 which are respectively coupled to the terminals 36 and 37 of the battery 26. Inertial safety switch 34 is secured to base 32 by any suitable means and is electrically connected to the electronic assembly 33 by wire 35 which is coupled to the top of the safety switch.

FIG. 2 of the drawings discloses the unique inertial, normally closed, safety switch herein employed, prior to its actuation. This apparatus is held in position on base 32, shown in FIG. 1, by suitable fastening means inserted in holes 53 and 54 in the base 52 of the switch assemlby. Cylinder 56 is secured to base 52 by threads 55. Thus, when the mine vehicle is falling to earth the respective position of the inertial switch assembly is as shown in the figure, i.e., with cap 63 pointed downward. Inertial mass or piston 58 is normally supported in the position shown by coil spring 57 which communicates at its lower end with the cap 63 of this switch assembly. Cap 63 has a bore in which the shearing member 62 is fitted and is connected physically to cylinder 56 by any suitable means, such as threads 59. Both cap 63 and shearing member 62 have a small longitudinal hole therein within which wire 35 is to be inserted and are preferably composed of an insulating material, such as Teflon. Wire 35 is secured to the exterior of the switch apparatus, that is, to the outside wall of cylinder 56 by some suitable means, such as tie cords 65. Cap 63 is covered with a retaining element, adhesive tape 64 so that shearing member 62 will not be dropped completely from the switch assembly when wire 35 is broken.

In the operation of this switch, inertial mass or piston 58 will initially be forced against base 52 by spring 57. When the mine vehicle strikes the ground, the inertial mass will compress the spring 57 and the extended portion 66 thereof will strike shearing member 62 which in turn will break that portion of wire 35 which extends through the hole in the shearing member. When the wire is broken, a short circuit is removed across the electrical element which is to be energized.

Coil spring 57 is designed to have sufficient inertia so that instantaneous acceleration forces of considerably large magnitudes applied to the switch will not cause the piston 58 to sufficiently compress the coil spring. The forces must be applied to the inertial switch for a finite period of time rather than an instantaneous period of time to enable the extended portion 66 to strike the shearing member 62. Thus, for example, if the inertial switch is dropped from a distance of 40 feet on a steel plate causing a force of 20,000 g's to be instantly exerted on the assembly, the switch will not be actuated; but if the switch is dropped from a height of 1,000 feet from the air into soil with a resulting force of less than 1,000 g's the switch will be actuated.

There has been herein disclosed a unique inertial responsive safety switch for use in an aerial implanted land mine which takes advantage of the fact that a regular soil drop from a high altitude has a greater energy factor than a short drop, such as might occur accidentally during loading. The design of the novel switch of the present invention is thus based on the total energy of the deceleration rather than the deceleration itself.

It will be understood that various changes in the details, materials, steps and arrangement of parts, which have been herein described and illustrated in order to explain the nature of the invention, may be made by those skilled in the art within the principles and scope of the invention as expressed in the appended claims.

What is claimed is:

1. An inertial switch comprising a cylinder, a cap secured to one end of said cylinder, said cap having a central bore therethrough running parallel to said cylinder and a transverse hole communicating with said bore a wire inserted in the hole in said cap; a shearing member mounted in the bore, having a hole in which said wire is inserted and having a portion extending into the interior of said cylinder; a coil spring located within said cylinder having one end contacting said cap; a base secured to the other end of said cylinder; and a piston contacting said spring and base and having an elongated central portion; said spring being relatively long compared to the length required to stop the elongated portion of said piston from striking the portion of said shearing member extending into the interior of said cylinder when the switch is dropped from a distance of 40 feet onto a steel plate, whereby said wire is broken when only a predetermined sufficient energy is imparted to said spring.

2. The switch of claim 1 wherein said cap includes means to stop movement of said shearing member when said wire is broken.

* * * * *